US005657599A

United States Patent [19]

Peterson et al.

[11] Patent Number: 5,657,599

[45] Date of Patent: Aug. 19, 1997

[54] DRY WALL BUTT STUD

[76] Inventors: Raymond J. Peterson, 62 Charter Rd., Selden, N.Y. 11784; George C. Harris, 3 Stuyvesant Ct., Port Jefferson Station, N.Y. 11776

[21] Appl. No.: 505,976

[22] Filed: Jul. 24, 1995

[51] Int. Cl.[6] ..... E04B 2/06

[52] U.S. Cl. ..... 52/417; 52/460; 52/463; 52/733.4

[58] Field of Search ..... 52/416, 417, 418, 52/419, 420, 460, 461, 463, 464, 720.1, 724.1, 733.2, 733.3, 733.4, 739.1

[56] References Cited

U.S. PATENT DOCUMENTS

| | | | |
|---|---|---|---|
| 811,003 | 1/1906 | Tudor | 52/739.1 |
| 1,658,407 | 2/1928 | Gustaveson . | |
| 3,090,087 | 5/1963 | Miller | 52/417 X |
| 3,675,383 | 7/1972 | Paoletti | 52/417 X |
| 4,201,025 | 5/1980 | Williamson | 52/733.4 X |
| 4,237,669 | 12/1980 | Hunter | 52/417 |
| 4,392,336 | 7/1983 | Ganssle | 52/417 |
| 4,467,578 | 8/1984 | Weinar . | |
| 5,394,665 | 3/1995 | Johnson . | |

FOREIGN PATENT DOCUMENTS

| | | | |
|---|---|---|---|
| 229836 | 6/1960 | Australia | 52/417 |
| 351243 | 1/1990 | European Pat. Off. | 52/720.1 |

*Primary Examiner*—Carl D. Friedman
*Assistant Examiner*—Kevin D. Wilkens
*Attorney, Agent, or Firm*—Michael I. Kroll

[57] ABSTRACT

A dry wall butt stud which comprises a structure between two upright wall studs, for back blocking short vertical butt edges of two horizontally aligned rectangular plasterboard sheets, which are mounted to the wall studs offset from an upper horizontally positioned rectangular plasterboard sheet and a lower horizontally positioned rectangular plasterboard sheet. The back blocking structure will form a recessed area at the short vertical butt edges, allowing a person to apply tape and a joint compound thereto to maintain a flat smooth front surface therebetween in the recessed area.

6 Claims, 3 Drawing Sheets

DRY WALL BUTT STUD

BACKGROUND OF THE INVENTION

1. Field of the Invention

The instant invention relates generally to interior wall framing construction and more specifically it relates to a dry wall butt stud.

2. Description of the Prior Art

Numerous interior wall framing construction have been provided in prior art. For example, U.S. Pat. No. 1,658,407 to Gustaveson; U.S. Pat. No. 4,467,578 to Weinar and U.S. Pat. No. 5,394,665 to Johnson all are illustrative of such prior art. While these units may be suitable for the particular purpose to which they address, they would not be as suitable for the purposes of the present invention as heretofore described.

GUSTAVESON, PALMER

NAILING BLOCK FOR COMPOSITE WALLS

U.S. Pat. No. 1,658,407

The combination with a flanged metal wall member of a nailing block having one of its faces formed so as to fit between the flanges of the wall forming member. Vertically disposed shoulders are formed on the side faces of the block for engagement with the edges of the flanges of the wall forming member. Means for securing the nailing block to the wall member. The means comprises an open loop of resilient metal.

WEINAR, ROGER N.

CONCEALABLE WALLBOARD FASTENER AND WALLS AND PARTITIONS ASSEMBLED WITH THE AID THEREOF

U.S. Pat. No. 4,467,578

Walls and partitions are constructed by securing wallboard panels to a substructure, such as one of conventional metal or other framing members, by a series of concealed fastening clips, some of which are affixed to the framing members by nail or screw fasteners and others of which, while not held to the framing members, help hold adjacent wallboard panels together and in alignment with each other at the panel sides, which are usually in abutting relationship. The fastening clips are made from sheet or strip material and include a base portion having a substructure contacting surface and a panel contacting surface spaced apart by intermediate strengthening walls, a web portion at about a right angle to the base portion and tab means extending from the web portion and suitable for entering the side of the panel to which the clip is to be appended. Preferably, the bases of such clips are substantially rectangular or are shaped like a T and include longitudinal rails or an equivalent part, and a plate portion, with intermediate strengthening walls. In walls or partitions assembled with the aid of such clips, which wall or partitions are disassemblable without harming the wallboard panels, series of such clips are applied alternately to abutting panel sides, with the clips on the wallboard on one side being held to the substructure and the panel side, and the clips on the wallboard on the other side being held to the panel side but not to the substructure. In a preferred aspect of the invention the basic clip structure is modified to include "latch" or "catch" means on a plurality of clips to be held to one side of a panel board and to the substructure and the other of such catch or latch means on a corresponding plurality of complementary clips to be held to the abutting side of another panel board, with such sets of clips, or mounting means being capable of being fitted together and easily separated, so as to promote ease of removal of individual wallboard panels without the need to remove adjacent panels.

JOHNSON, GARY

STUD WALL FRAMING CONSTRUCTION

U.S. Pat. No. 5,394,665

A stud wall framing construction comprises a lower track, an upper track aligned with and vertically spaced from the lower track and a plurality of vertically aligned studs positioned between the lower and upper tracks. The lower and upper end portions of the studs are positioned within the lower and upper tracks, respectively. Each of the lower and upper tracks includes a channel with opposed track sidewalls and a track base wall. The track sidewalls have a plurality of inwardly projecting track protrusions formed from the sidewalls. Each of the track protrusions on one of the sidewalls is paired with another track protrusion disposed across the opposite sidewall. The lower and upper end portions of the studs has opposed stud sidewalls and plurality of inwardly projecting stud protrusions formed from the stud sidewalls. Each of the stud protrusions one of the stud sidewalls is paired with another stud protrusion disposed across the opposite stud sidewall. The track and stud protrusions are adapted such that each of the pair track protrusions nest into a respective pair of stud protrusions, thereby locking the studs in the tracks.

SUMMARY OF THE INVENTION

A primary object of the present invention is to provide a dry wall butt stud, that will overcome the shortcomings of the prior art devices.

Another object is to provide a dry wall butt stud, which will create a recessed area at short vertical butted edges of two plasterboard sheets when an interior wall is being constructed, which are not normally finished with a slight taper as on the long edges, so that when a person is taping with a joint compound a flat smooth vertical seam will be maintained therebetween.

An additional object is to provide a dry wall butt stud, which when installed will enable a person doing the taping to cover the vertical seam in a less amount of time, thereby reducing labor costs needed for the job.

A further object is to provide a dry wall butt stud that is simple and easy to use.

A still further object is to provide a dry wall butt stud that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
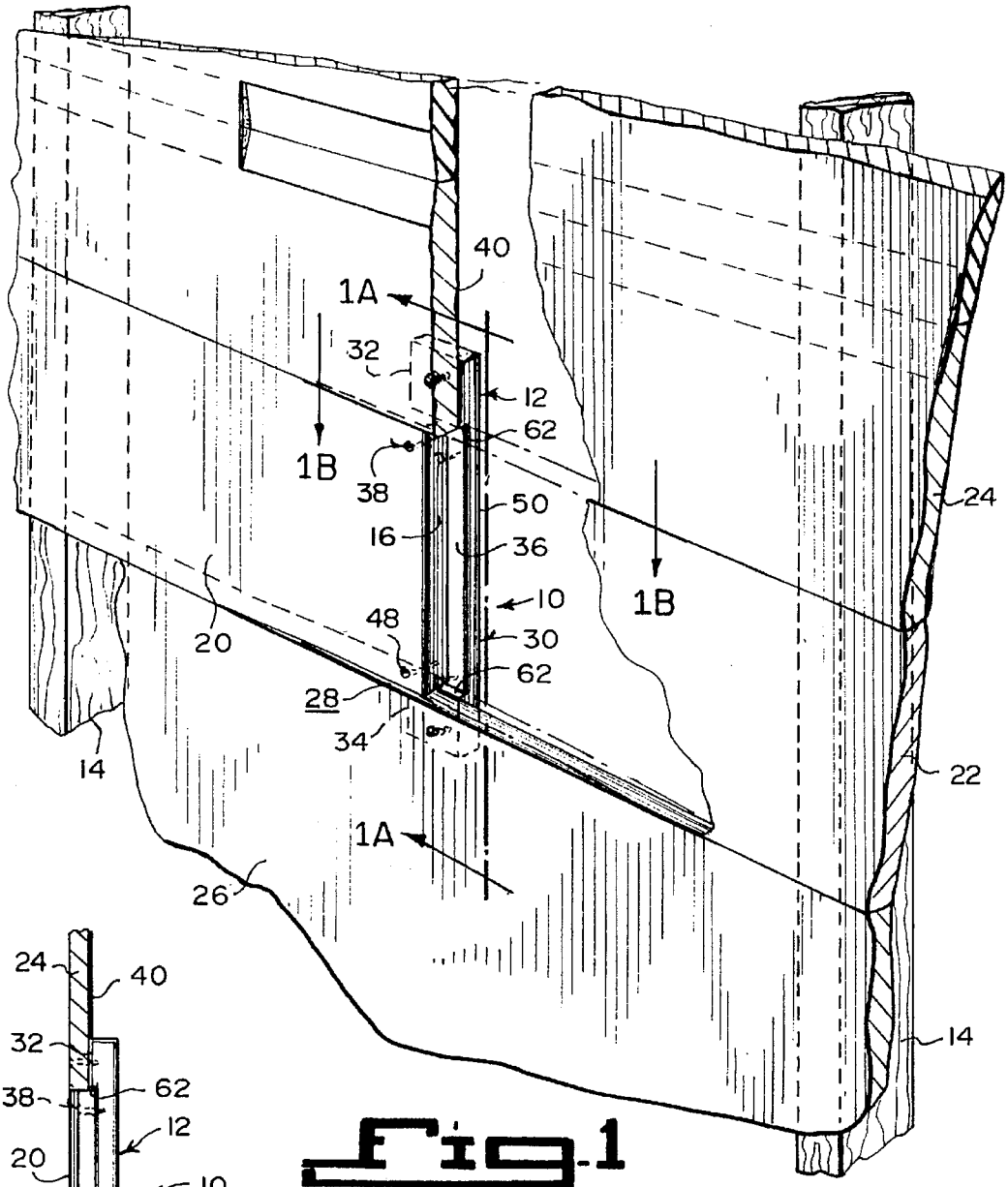
FIG. 1 is a front perspective view of a portion of an interior wall with parts broken away and in section, showing a first embodiment of the instant invention in use.
Figure 1A:
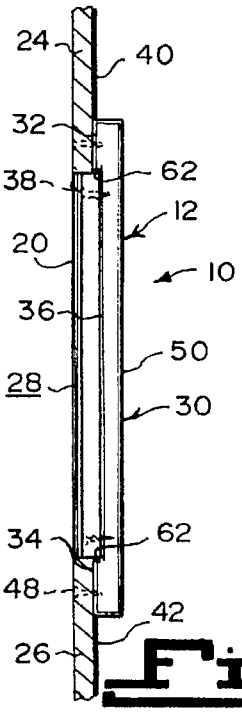
FIG. 1A is a vertical cross sectional view taken along line 1A—1A in FIG. 1.
Figure 1B:
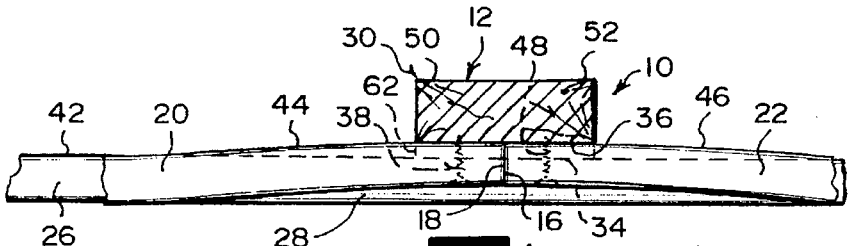
FIG. 1B is a horizontal cross sectional view taken along line 1B—1B in FIG. 1.
Figure 2:
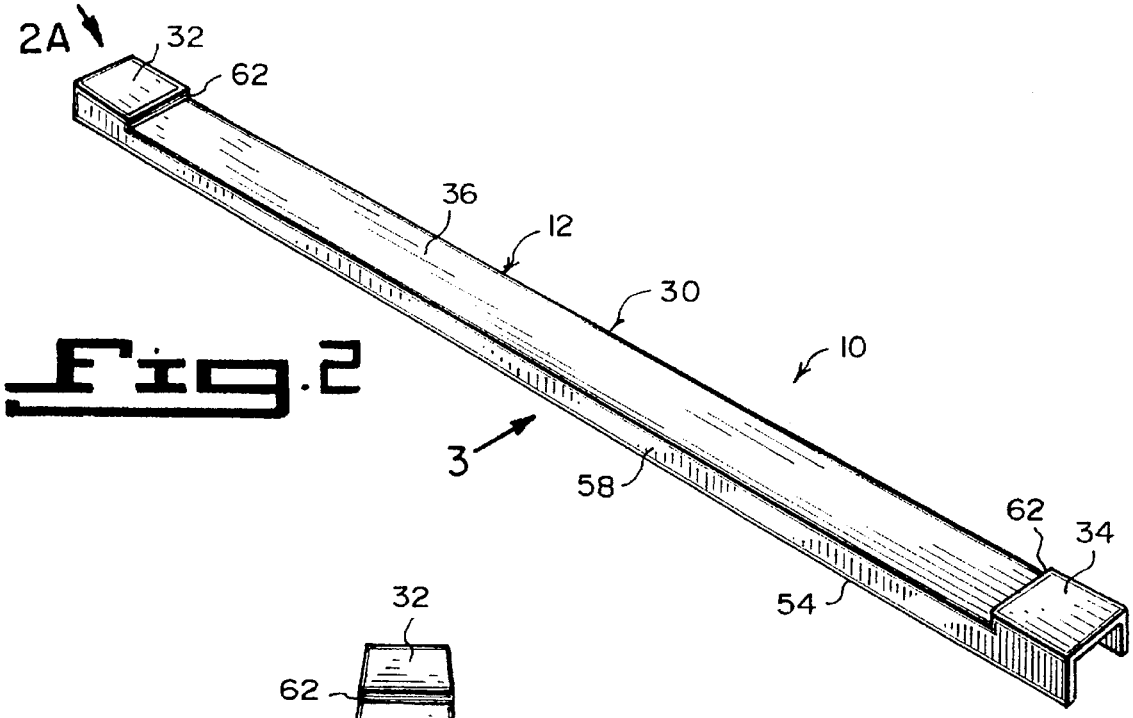
FIG. 2 is a side perspective view of a second embodiment of the instant invention.
Figure 2A:
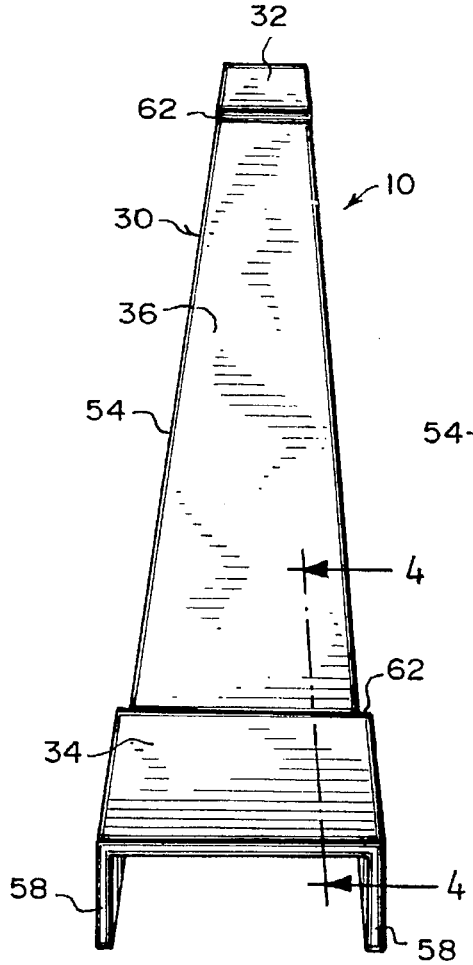
FIG. 2A is an end perspective view taken in the direction of arrow 2A in FIG. 2.
Figure 3:
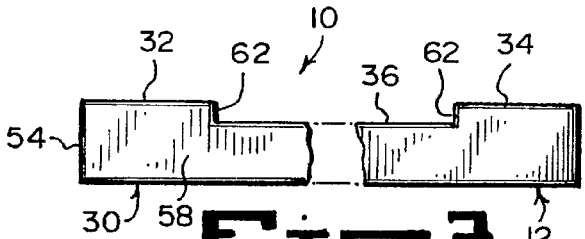
FIG. 3 is a side elevational view with parts broken away taken in the direction of arrow 3 in FIG. 2.
Figure 4:
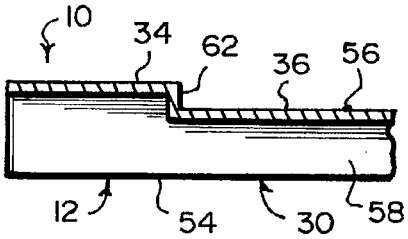
FIG. 4 is a cross sectional view taken along line 4—4 in FIG. 2A.
Figure 5:
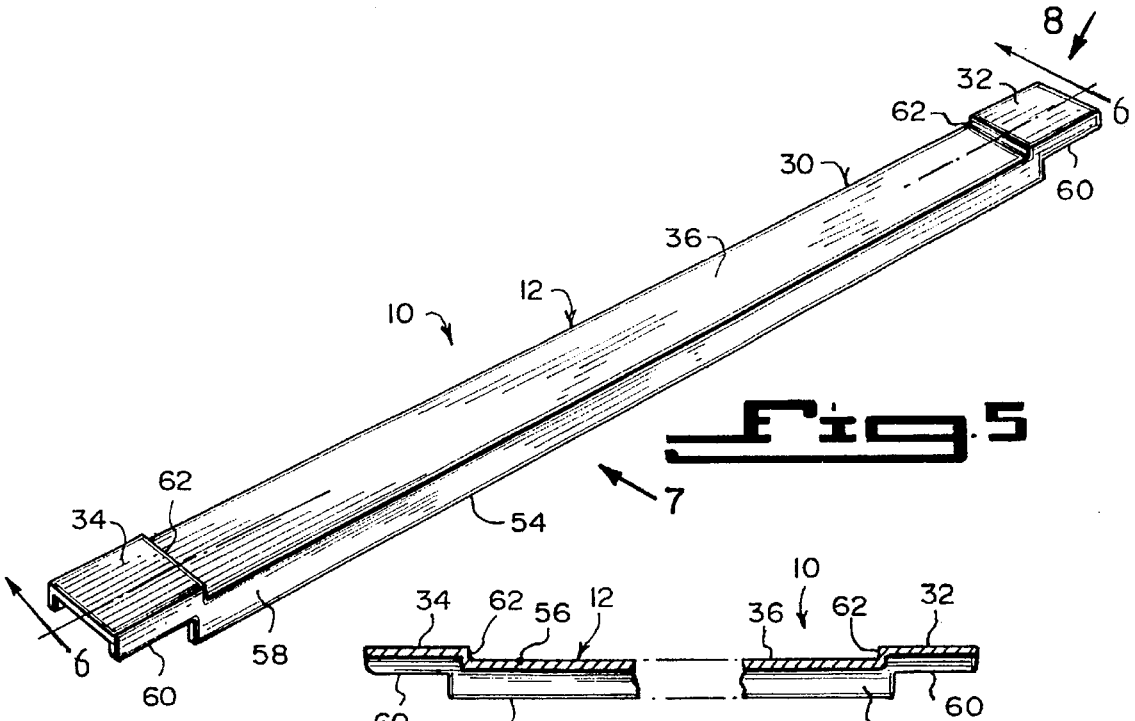
FIG. 5 is a side perspective view of a third embodiment of the instant invention.
Figure 6:
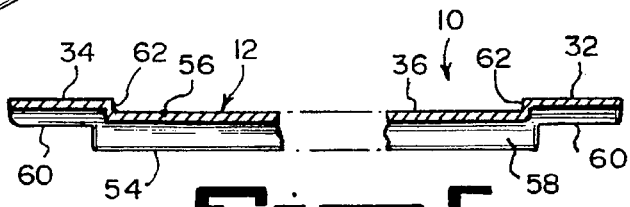
FIG. 6 is a cross sectional view with parts broken away taken along line 6—6 in FIG. 5.
Figure 7:
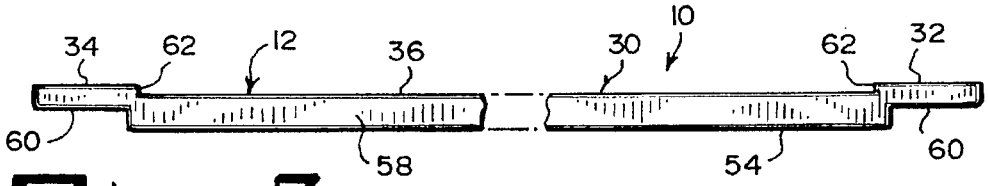
FIG. 7 is a side elevational view with parts broken away taken in the direction of arrow 7 in FIG. 5.
Figure 8:
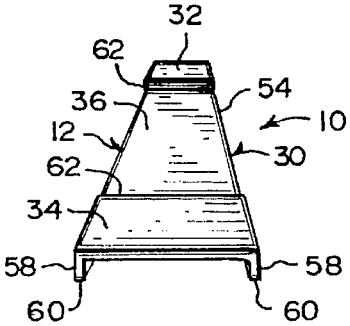
FIG. 8 is an end perspective view taken in the direction of arrow 8 in FIG. 5.

Turning now descriptively to the drawings, in which similar reference characters denote similar elements throughout the several views, FIGS. 1, 1A and 1B illustrate a dry wall butt stud 10, which comprises a structure 12 between two upright wall studs 14, for back blocking short vertical butt edges 16, 18 of two horizontally aligned rectangular plasterboard sheets 20, 22, which are mounted to the wall studs 14 offset from an upper horizontally positioned rectangular plasterboard sheet 24 and a lower horizontally positioned rectangular plasterboard sheet 26. The back blocking structure 12 will form a recessed area 28 at the short vertical butt edges 16, 18, allowing a person to apply tape and a joint compound thereto to maintain a flat smooth front surface therebetween in the recessed area 28.

The back blocking structure 12 includes a post 30 having a pair of raised end pieces 32, 34 located on opposite sides of a lowered central portion 36. The length of the lowered central portion 36 is of an equal size to the width of the two horizontally aligned rectangular plasterboard sheets 20, 22.

A plurality of fasteners 38 are provided, for securing the first raised end piece 32 to a rear surface 40 of the upper horizontally positioned rectangular plasterboard sheet 24, the second raised end piece 34 to a rear surface 42 of the lower horizontally positioned rectangular plasterboard sheet 26, and the lowered central portion 36 to a rear surface 44, 46 at the short vertical butt edges 16, 18 of the two horizontally aligned rectangular plasterboard sheets 20, 22. Abutting segments of the two horizontally aligned rectangular plasterboard sheets 20, 22 will bend inwardly to form the recessed area 28, as best seen in FIG. 1B.

Each fastener 38 is a screw 48. The post 30 is a generally rectangular block member 50. The post 30 is fabricated out of wood 52.

The post 30 in FIGS. 2 to 8, is a generally rectangular channel member 54, having a C-shaped configuration in cross section. The post 30 is fabricated out of metal or wood 56. In FIGS. 5 through 8, the generally rectangular channel member 54 includes each side flange 58 having a cut back area 60 under each raised end pieces 32, 34.

Each raised end piece 32, 34 of the post 30 is approximately two inches in width by three inches in length. The lowered central portion 36 of the post 30 is approximately two inches in width by forty eight and one quarter inches in length, which is about the width of all of the rectangular plasterboard sheets 20, 22, 24 and 26. The rise 62 between each raised end piece 32, 34 and the lowered central portion 36 of the post 30 is approximately one quarter of an inch, which is about the thickness of all of the rectangular plasterboard sheets 20, 22, 24 and 26.

OPERATION OF THE INVENTION

To use the dry wall butt stud 10, the following steps should be taken:

1. Mount the first rectangular plasterboard sheet 20 to the wall studs 14 horizontally below and offset from the third rectangular plasterboard sheet 24 and above the fourth rectangular plasterboard sheet 26.

2. Mount the second rectangular plasterboard sheet 22 to the wall studs 14 horizontally below and offset from the third rectangular plasterboard sheet 24 and above the fourth rectangular plasterboard sheet 26.

3. Make sure that the butt edge 16 of the first rectangular plasterboard sheet 20 contacts the butt edge 18 of the second rectangular plasterboard sheet 22 between the studs 14.

4. Insert a screw 58 through the third rectangular plasterboard sheet 24, so that the first raised end piece 32 engages with the rear surface 40.

5. Insert a screw 48 through the fourth rectangular plasterboard sheet 26, so that the second raised end piece 34 engages with the rear surface 42.

6. Insert the rest of the screws 48 through the butt edge 16 and the butt edge 18, so that the lowered central portion 36 engages with the rear surface 44 and 46, thereby forming the recessed area 28.

7. Apply the joint compound and tape into the recessed area 28, to form the flat smooth front surface.

LIST OF REFERENCE NUMBERS

10 dry wall butt stud
12 back blocking structure of 10
14 wall stud
16 butt edge of 20
18 butt edge of 22
20 first rectangular plasterboard sheet
22 second rectangular plasterboard sheet
24 third rectangular plasterboard sheet
26 fourth rectangular plasterboard sheet
28 recessed area at 16, 18
30 post for 12
32 first raised end piece on 30
34 second raised end piece on 30
36 lowered central portion on 30
38 fastener
40 rear surface of 24
42 rear surface of 26
44 rear surface of 20
46 rear surface of 22
48 screw for 38

50 generally rectangular block member for 30
52 wood of 30
54 generally rectangular channel member
56 metal or wood of 30
58 side flange of 54
60 cut back area on 58
62 rise between 32, 36 and 34, 36

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A dry wall butt stud in combination with a plurality of studs and drywall panels, comprising means between two upright wall studs, for back blocking short vertical butt edges of two horizontally aligned rectangular plasterboard sheets, which are mounted to the wall studs offset from an upper horizontally positioned rectangular plasterboard sheet, so that said back blocking means forms a recessed area at the short vertical butt edges, allowing a person to apply tape and a joint compound thereto to maintain a flat smooth front surface therebetween in the recessed area, said blocking means including a post having first and second raised end pieces located on opposite sides of a lowered central portion in which the length of said lowered central portion is of an equal size to the width of the two horizontally aligned rectangular plasterboard sheets, and a plurality of fasteners, for securing said first raised end piece to a rear surface of the upper horizontally positioned rectangular plasterboard sheet, said second raised end piece to a rear surface of a lower horizontally positioned rectangular plasterboard sheet, and said lowered central portion to a rear surface at the short vertical butt edges of the two horizontally aligned rectangular plasterboard sheets, whereby abutting segments of the two horizontally aligned rectangular plasterboard sheets bend inwardly to form the recessed area, said fasteners being screws, said post being a generally rectangular block member fabricated out of wood.

2. A dry wall butt stud as recited in claim 1, wherein said post is a generally rectangular channel member having a C-shaped configuration in cross section.

3. A dry wall butt stud as recited in claim 1, wherein said generally rectangular channel member includes side flanges having a cut back area under each said raised end piece.

4. A dry wall butt stud recited in claim 3, wherein each said raised end piece of said post is approximately two inches in width by three inches in length.

5. A dry wall butt stud as recited in claim 4, wherein said lowered central portion of said post is approximately two inches in width by forty eight and one quarter inches in length, which is about the width of all of the rectangular plasterboard sheets.

6. A dry wall butt stud as recited in claim 5, wherein each said raised end piece is offset, with regard to said lowered central portion of said post by approximately one quarter of an inch, which is about the thickness of all of the rectangular plasterboard sheets.

* * * * *